US008884150B2

(12) United States Patent
Swanson

(10) Patent No.: US 8,884,150 B2
(45) Date of Patent: Nov. 11, 2014

(54) MICROPHONE ARRAY TRANSDUCER FOR ACOUSTICAL MUSICAL INSTRUMENT

(71) Applicant: David Carl Swanson, State College, PA (US)

(72) Inventor: David Carl Swanson, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 13/953,049

(22) Filed: Jul. 29, 2013

(65) Prior Publication Data

US 2014/0033904 A1 Feb. 6, 2014

Related U.S. Application Data

(60) Provisional application No. 61/679,153, filed on Aug. 3, 2012, provisional application No. 61/692,778, filed on Aug. 24, 2012.

(51) Int. Cl.
*G10H 3/12* (2006.01)
*G10H 3/18* (2006.01)

(52) U.S. Cl.
USPC ..... 84/723; 84/733; 84/734

(58) Field of Classification Search
USPC ..... 84/723, 733, 734
See application file for complete search history.

(56) References Cited

U.S. PATENT DOCUMENTS 2,845,491 A 7/1958 Bertram
2,921,993 A 1/1960 Beaverson
3,301,118 A * 1/1967 Keane et al. ..... 84/1
4,025,724 A * 5/1977 Davidson et al. ..... 381/71.2
4,193,332 A * 3/1980 Richardson ..... 84/660
4,748,886 A * 6/1988 De Byl ..... 84/723
5,010,803 A * 4/1991 Donnell ..... 84/743
5,223,660 A * 6/1993 Wahlgreen ..... 84/731
5,526,430 A * 6/1996 Ono et al. ..... 381/26
5,559,893 A * 9/1996 Krokstad et al. ..... 381/71.7
5,614,688 A * 3/1997 Donnell ..... 84/743
5,651,074 A * 7/1997 Baumhauer et al. ..... 381/170
5,673,325 A * 9/1997 Andrea et al. ..... 381/92

(Continued)

FOREIGN PATENT DOCUMENTS

DE 10015762 A1 10/2001
FR 1522906 A 4/1968

(Continued)

OTHER PUBLICATIONS

Garrison, M., "The Encyclopedia of Home Recording: A Complete Resource for the Home Recording Studio," Independent Published Platform, 2011, p. 232, 233, Fig. 130.

(Continued)

*Primary Examiner* — David S. Warren

(74) *Attorney, Agent, or Firm* — Gifford, Krass, Sprinkle, Anderson & Citkowski, P.C.; Douglas L. Wathen

(57) ABSTRACT

A dipole microphone array is provided for an acoustical stringed instrument of the type having a body and a plurality of strings spaced from the body. The array includes a plurality of microphone assemblies each having a first and a second microphone. The second microphone is out of phase with the first microphone so as to provide a dipole microphone assembly. Each of the microphone assemblies is mounted on the body of the instrument in close proximity to one of the strings.

23 Claims, 4 Drawing Sheets

(56) References Cited

U.S. PATENT DOCUMENTS

| | | | | |
|---|---|---|---|---|
| 5,969,838 | A * | 10/1999 | Paritsky et al. | 398/136 |
| 6,121,528 | A * | 9/2000 | May | 84/411 R |
| 6,157,724 | A * | 12/2000 | Kawakami | 381/63 |
| 6,191,346 | B1 * | 2/2001 | Swan | 84/307 |
| 6,191,348 | B1 * | 2/2001 | Johnson | 84/485 R |
| 6,441,292 | B1 * | 8/2002 | Donnell | 84/723 |
| 6,525,993 | B2 | 2/2003 | Wake et al. | |
| 7,024,006 | B1 * | 4/2006 | Schwartz et al. | 381/98 |
| 7,297,863 | B2 * | 11/2007 | May | 84/723 |
| 7,534,954 | B1 * | 5/2009 | Cassista | 84/731 |
| 7,723,605 | B2 * | 5/2010 | Gremo et al. | 84/723 |
| 7,844,069 | B2 * | 11/2010 | Banks | 381/361 |
| 8,017,849 | B2 * | 9/2011 | Tajima et al. | 84/604 |
| 8,098,844 | B2 * | 1/2012 | Elko | 381/94.1 |
| 8,315,418 | B2 * | 11/2012 | Watanabe | 381/358 |
| 2003/0121403 | A1 * | 7/2003 | Miyagishima et al. | 84/735 |
| 2006/0269089 | A1 | 11/2006 | Gieson | |
| 2008/0031726 | A1 | 2/2008 | Bernardus Olthof et al. | |
| 2008/0205669 | A1 * | 8/2008 | Michelet | 381/118 |
| 2008/0310664 | A1 * | 12/2008 | Khenkin et al. | 381/361 |
| 2009/0154715 | A1 * | 6/2009 | Lyon et al. | 381/59 |
| 2009/0241756 | A1 * | 10/2009 | Tajima et al. | 84/604 |
| 2010/0288109 | A1 * | 11/2010 | Van Kelst | 84/726 |
| 2011/0129098 | A1 * | 6/2011 | Delano et al. | 381/71.11 |
| 2011/0194703 | A1 * | 8/2011 | Akino et al. | 381/26 |
| 2011/0290098 | A1 * | 12/2011 | Thuillier | 84/645 |
| 2011/0311064 | A1 | 12/2011 | Teutsch | |
| 2011/0312318 | A1 * | 12/2011 | Konchitsky | 455/422.1 |
| 2012/0060669 | A1 * | 3/2012 | Ryan et al. | 84/723 |
| 2012/0060670 | A1 * | 3/2012 | Truchsess | 84/724 |
| 2012/0087518 | A1 * | 4/2012 | Simidian et al. | 381/120 |
| 2012/0215519 | A1 * | 8/2012 | Park et al. | 704/2 |
| 2012/0269367 | A1 * | 10/2012 | Akino | 381/174 |
| 2013/0061734 | A1 * | 3/2013 | Koseki et al. | 84/189 |
| 2013/0112068 | A1 * | 5/2013 | Rogers | 84/723 |
| 2013/0272539 | A1 * | 10/2013 | Kim et al. | 381/92 |
| 2013/0272540 | A1 * | 10/2013 | hgren et al. | 381/94.1 |
| 2013/0282369 | A1 * | 10/2013 | Visser et al. | 704/226 |
| 2013/0282372 | A1 * | 10/2013 | Visser et al. | 704/233 |
| 2013/0282373 | A1 * | 10/2013 | Visser et al. | 704/233 |
| 2013/0312590 | A1 * | 11/2013 | Truchsess | 84/725 |
| 2013/0317830 | A1 * | 11/2013 | Visser et al. | 704/500 |
| 2013/0322637 | A1 * | 12/2013 | Akino | 381/58 |
| 2013/0322643 | A1 * | 12/2013 | Every et al. | 381/71.14 |
| 2013/0333546 | A1 * | 12/2013 | Kondo et al. | 84/731 |
| 2014/0033904 | A1 * | 2/2014 | Swanson | 84/723 |
| 2014/0067386 | A1 * | 3/2014 | Zhang et al. | 704/226 |

FOREIGN PATENT DOCUMENTS

| | | | |
|---|---|---|---|
| WO | WO-03041285 | A1 | 5/2003 |
| WO | WO-2007106399 | A2 | 9/2007 |
| WO | WO-2011087770 | A2 | 7/2011 |

OTHER PUBLICATIONS

ISR and Written Opinion issued in connection with co-pending PCT Application No. PCT/US2013/052502 on Nov. 14, 2013.

* cited by examiner

FIG. 7
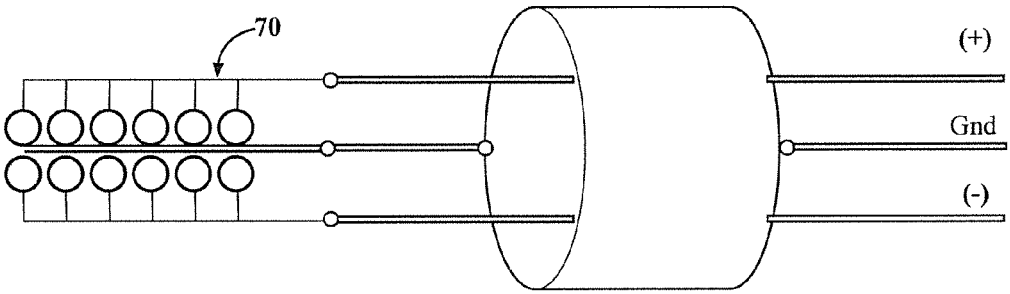
FIG. 8
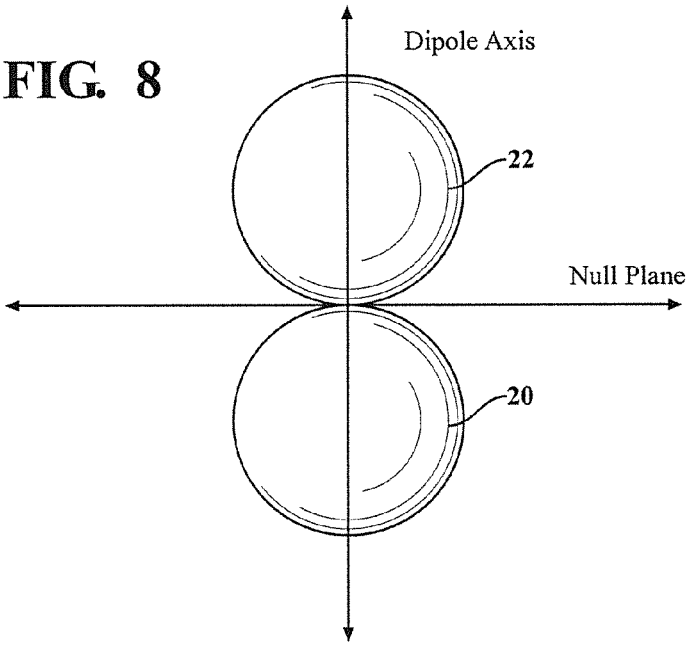
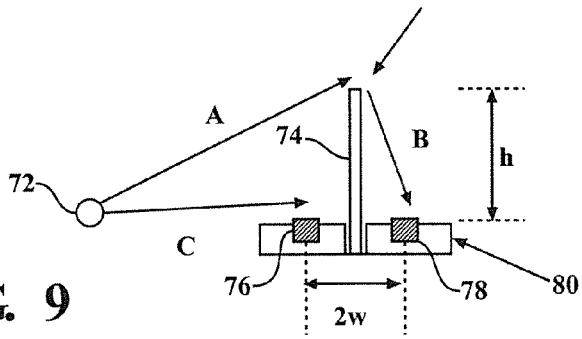
FIG. 9

MICROPHONE ARRAY TRANSDUCER FOR ACOUSTICAL MUSICAL INSTRUMENT

CROSS REFERENCE TO RELATED APPLICATIONS

This U.S. patent application claims priority from U.S. provisional patent application Ser. No. 61/679,153, filed Aug. 3, 2012, and U.S. provisional patent application Ser. No. 61/692,778, filed Aug. 24, 2012, both of which are incorporated herein in their entirety.

FIELD OF THE INVENTION

The present invention relates generally to transducers for converting sound waves to an electrical signal for amplification, especially for acoustic musical instruments such as guitars.

BACKGROUND OF THE INVENTION

While there have been numerous early inventions of the electric guitar, George D. Beauchamp 1939 patent (U.S. Pat. No. 2,152,783 filed May 26, 1936) can be seen as the first design incorporating a magnetic induction transducer as a means to suppress the problem of acoustic feedback from the amplifier and loudspeaker. Feedback occurs when the guitar transducer senses the amplified signal through the loudspeaker as being as loud as, or louder than, the vibrating string of the guitar. It is still possible to apply enough gain or to place the guitar close to the loudspeaker and create an unstable feedback howling sound, but the magnetic induction pickup has proven to be the most effective at keeping feedback under control. Unfortunately, the electronic signal of a magnetic induction pickup lacks the high frequency structure to reproduce the acoustic guitar sound one hears without amplification. Vibration sensors can be used which offer a closer sound image than the magnetic induction pickup, but the vibration signal is not the same as the acoustic signal and the vibration signal is still sensitive to uncontrolled acoustic feedback.

SUMMARY OF THE INVENTION

An embodiment of the present invention provides an array of dipole microphones each in very close proximity to a vibrating acoustic guitar string to both faithfully reproduce the sound one hears while also suppressing uncontrolled acoustic feedback from the amplified guitar signal reproduced by the loudspeaker. The dipole microphone array (DMA) exploits this close proximity to enhance sensitivity to the acoustic waves from the vibrating strings and sound hole of the guitar while suppressing sounds further away, such as a loudspeaker reproducing the acoustic guitar sounds, and thus uncontrolled acoustic feedback. Some embodiments include a small baffle in the array, and diffraction over this baffle further improves performance.

In one embodiment of the present invention, a dipole microphone array is provided for an acoustical stringed instrument of the type having a body and a plurality of strings spaced from the body. The array includes a plurality of microphone assemblies each having a first and a second microphone. The second microphone is out of phase with the first microphone so as to provide a dipole microphone assembly. Each of the microphone assemblies is mounted on the body of the instrument in close proximity to one of the strings. In some versions, each microphone assembly is mounted generally equidistant to two of the strings.

In particular embodiments, the dipole microphone array further includes a printed circuit board, and the first and second microphones of each microphone assembly are supported on the printed circuit board. The first and second microphones may be soldered to the printed circuit board.

In particular embodiments, the dipole microphone array further includes a baffle disposed between the first and second microphones of at least some of the microphone assemblies. The first and second microphone are separated by a first distance and the baffle in some versions has a height equal to or greater than the first distance.

In particular embodiments, the dipole microphone array further includes a vibrationally isolated windscreen disposed around the remainder of the dipole microphone array.

In particular embodiments, the first and second microphones define an orientation axis for each dipole microphone assembly and this orientation axis is angled with respect to an axis normal to the strings. In some versions, the orientation axis is angled with respect to the axis normal to the strings in the range of +45 degrees to −45 degrees.

In another embodiment of the present invention, a dipole microphone array is provided for an acoustical instrument of the type having a body. The array includes a plurality of microphone assemblies each having a first and a second microphone. The second microphone is out of phase with the first microphone so as to provide a dipole microphone. Each of the microphone assemblies is mounted on the body of the instrument.

In particular embodiments, the dipole microphone array further includes a printed circuit board, and the first and second microphones of each microphone assembly are supported on the printed circuit board. The first and second microphones may be soldered to the printed circuit board.

In particular embodiments, the dipole microphone array further includes a baffle disposed between the first and second microphones of at least some of the microphone assemblies. The first and second microphone are separated by a first distance and the baffle in some versions has a height equal to or greater than the first distance.

BRIEF DESCRIPTION OF THE DRAWINGS

FIG. 7 is a schematic showing top and bottom rows of microphones that are summed together, in accordance with an aspect of the present invention, to reduce a loss of performance from individual microphone sensitivity variability while also allowing for a convenient low impedance balanced line output;

FIG. 8 is a diagram illustrating dipole geometry, showing a dipole axis line and a null plane; and FIG. 9 is a schematic illustrating an addition of a small baffle between two microphones in a dipole, in accordance with a further aspect of the present invention, so as to enhance the signal output for nearfield sounds.

DETAILED DESCRIPTION OF THE INVENTION

Figure 1:
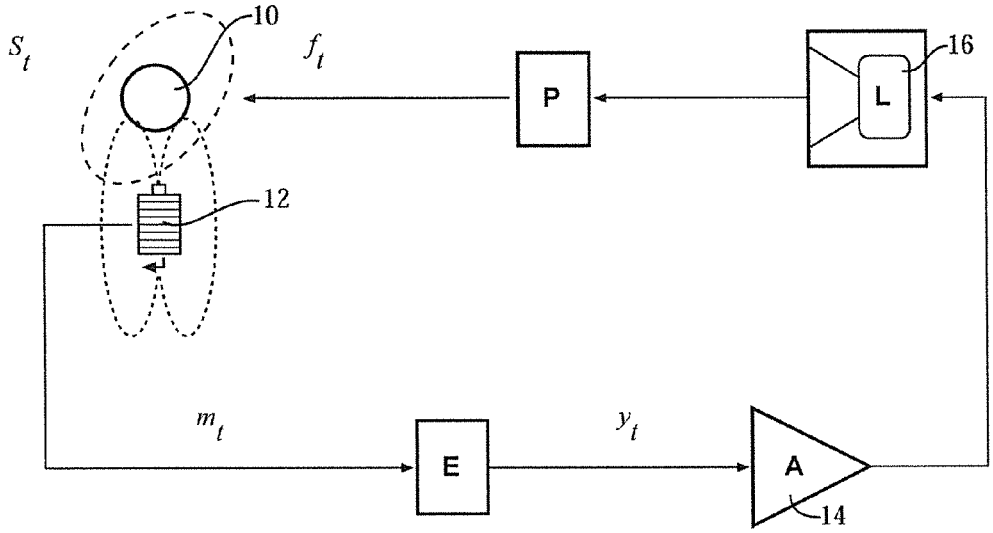
FIG. 1 PRIOR ART
FIG. 1 is a schematic depicting a fundamental acoustic feedback problem, showing the transducer response T(f) and feedback loop response E(f)A(f)L(f)P(f), or EALP, which must be less than unity to insure no unstable feedback.

A fundamental feedback problem is depicted in FIG. 1, which shows a signal path from a vibrating string 10, through an induction coil 12, amplifier 14, loudspeaker 16, and back through the air, inducing more vibration into the string and thus causing feedback. Even the induction pickup 12 is susceptible to uncontrolled feedback, but is generally much less sensitive to undesirable feedback compared to a vibration sensor or guitar mounted microphone. Hollow body electric guitars are more sensitive to acoustic feedback than solid body electric guitars because the hollow body vibrates more and this vibration excites the magnetic induction coil and strings more than in a solid body.

In the frequency domain the electrical signal from the pickup (magnetic or otherwise) is defined as:

$$M(f)=S(f)T(f) \tag{1.1}$$

Where S(f) is the frequency spectrum of the string sound to be amplified and reproduced through the loudspeaker and T(f) is the transfer function of the guitar pickup. When the sound F(f) from the loudspeaker feedback into the string is included, this signal becomes (dropping the f for brevity)

$$M = \frac{TS}{1 - EALP} \tag{1.2}$$

Equation 1.2 shows that if the amplifier is switched off (A=0) then the electrical signal reverts to equation 1.1. However, it is well known from control theory that if the magnitude of EALP exceeds unity where $|T|>0$, it is likely that the feedback will become unstable and lead to uncontrolled oscillations at the maximum volume the amplifier and loudspeaker can produce. Adaptive filters have been used to filter specific frequencies of feedback instability, but this also significantly alters the fidelity of the electric signal created by the guitar pickup.

Directional response microphones have been used to suppress distant noise sources. A single omni-directional microphone has the same sensitivity to sound from any direction and is called a monopole. A closely-spaced pair of microphones wired in opposite phase is called a dipole and will produce a "figure 8" shaped directivity pattern of sensitivity where the phase opposite sum cancels sound arriving at the microphones from a direction in a plane normal (the "Null Plane") to the axis line of the two microphones (the "Dipole Axis"). FIG. 8 illustrates the shape of the dipole sensitivity. The "sphere" of sensitivity below the Null Plane line, indicated at 20, is out of phase with the sphere of sensitivity above the Null Plane line, indicated at 22. Sound arriving from the Null Plane reaches the two microphones at the same time and is cancelled out by their opposite phases. As a sound source moves towards a position aligned with the Dipole Axis, the sounds is not cancelled out and is therefore picked up and amplified. Combining a dipole and monopole gives a heart-shaped directivity called a cardioid pattern so that the microphone is insensitive to sounds from just one direction. In some embodiments of the present invention, a cardioid microphone arrangement may be substituted for a dipole, but a dipole is preferred. These directivity patterns can also be approximated using a single microphone and multiple acoustic ports to feed in the sound. However, for application to a guitar, a very precise control of microphone location and positioning is required, which is very practical for a permanently mounted guitar pickup. The inventor has found that the preferred method to match the microphones in each dipole is to use a trimming potentiometer such that the microphone sensitivities through the DMA (dipole microphone array) are nearly identical for a distance source, and therefore cancelled when added together out-of-phase.

Figure 2:
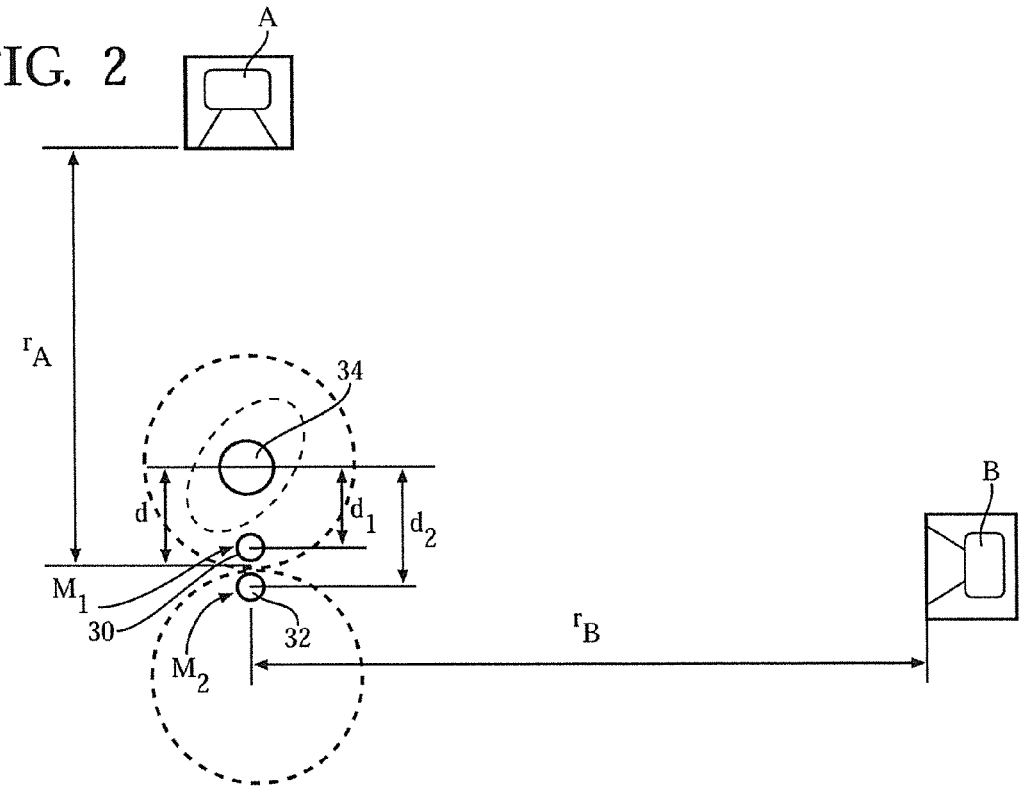
FIG. 2 is a schematic depicting a dipole microphone in close proximity to a vibrating guitar string acoustical nearfield, showing consistent cancellation in the direction of a loudspeaker "B" and low frequency attenuation in the direction of a loudspeaker "A"

FIG. 2 depicts a pair of closely-spaced microphones, M1 (30) and M2 (32), in very close proximity to a guitar's vibrating string 34. When these microphones are wired in opposite phase (out-of-phase) the sound from loudspeaker "B" on the right arrives at both microphones at precisely the same time and amplitude, thus the electrical sum of the two out-of-phase microphones is zero for all frequencies. In the direction of Loudspeaker "A" (the "worst case" direction) on the top of FIG. 2 the response is a little more complicated. Since the two microphones are separated by a distance $\Delta d=d_2-d_1$, there is a slight difference in the sound wave amplitude at the two microphones, so the signals do not completely cancel. At lower frequencies where the wavelength $\lambda=c/f$, (c being the sound speed in air of about 344 m/s), is longer, the cancellation is greater but not total. The directivity pattern remains a "figure 8" but the overall sensitivity decreases in the direction of loudspeaker "A" as frequency decreases. At high frequencies where $\Delta d=\lambda/2$, the sound wave from loudspeaker "A" is in opposite phase at the two microphones. Therefore, the out-of-phase electrical sum of the two microphones returns to in-phase and the two signals add, doubling the amplitude. This lowest peak will be referred to herein as the "half-wavelength peak" where it is desirable to use the dipole microphone at frequencies well below this point in frequency. At a higher frequency, where $\Delta d=\lambda$, there would be cancellation in both the loudspeaker "A" and "B" directions giving a "4-leaf clover" type of directivity pattern called a quadrapole. The response in the direction of loudspeaker "A" increases at a rate of 6 dB per octave up to the half-wavelength peak and always cancels in the direction of loudspeaker "B" (i.e. in the direction of the Null Plane). These loudspeakers are assumed to be at far distances rA and rB compared to the average microphone distance d to the string. The lower curve in FIG. 3 shows the 6 dB per octave rise in the dipole response to a distant loudspeaker up to the half wavelength peak.

The response of the dipole microphone in close proximity to the vibrating string is even more complicated than that to loudspeaker "A". The string does not move in unison but "flaps" with both transient traveling impulsive waves and resonating sinusoidal standing waves. In addition, the fluid around the string moves with a complex impedance, entraining air mass in motion with the string surface as well as producing pressure waves which radiate away acoustically at the speed of sound. The air adjacent to the vibrating string surface will also host waves that move both faster and slower than the speed of sound. The latter is known in the acoustics literature as an evanescent wave and is known to decay exponentially, not geometrically as 1/d, as one moves away from the vibrating string surface. This "near acoustic field" is quite different than the "far acoustic field" from the loudspeakers in FIG. 2. Because of this physical nearfield effect and our close proximity, the total sound field is dominated by the nearfield at microphone M1 (30) and it is substantially greater in amplitude than microphone M2 (32). This has the effect of removing the low frequency cancellation and flattening out the frequency response, but only for the string a few millimeters away, not the loudspeaker several meters away. This effect is well known as "the proximity effect" where the bass response of some microphones is boosted when the microphone is placed very close to the sound source.

Figure 3:
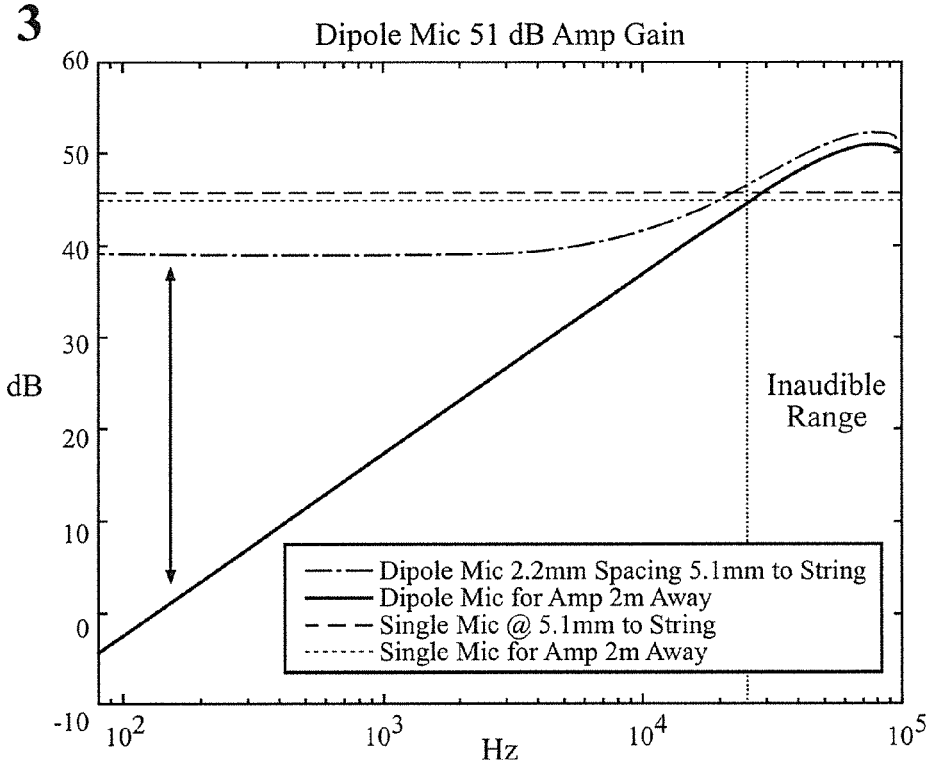
FIG. 3 is a graph comparing a single microphone to a dipole microphone located in very close proximity to a vibrating string, showing an increased stability margin for the dipole microphone at low frequencies.
Figure 4:
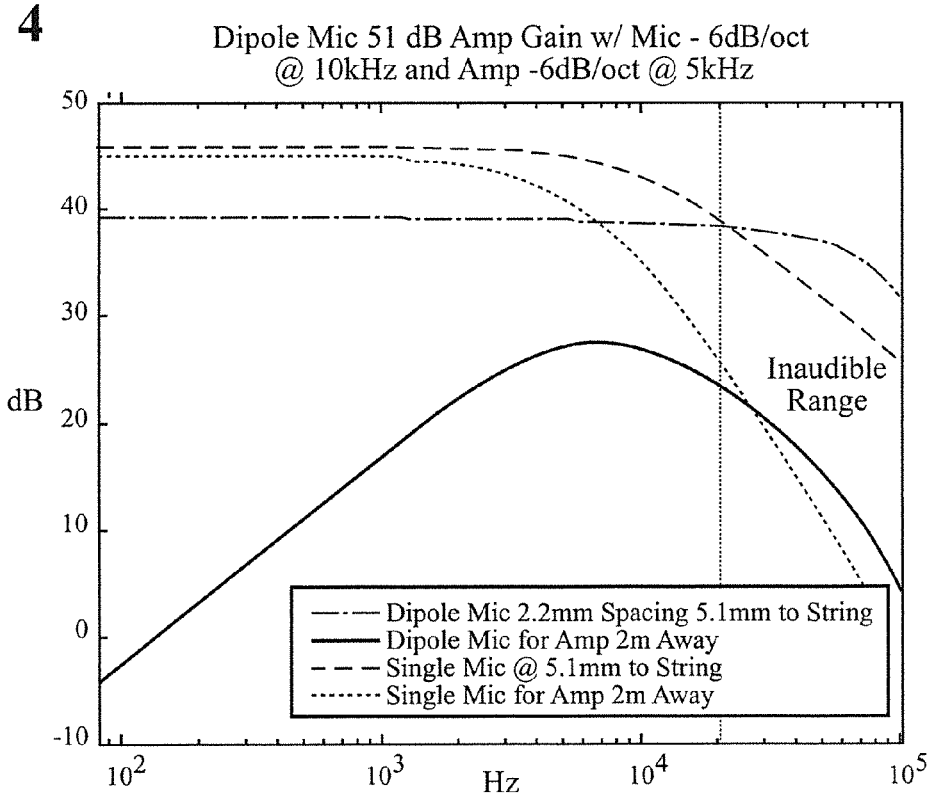
FIG. 4 is a graph depicting the dipole microphone response as flattened out with an increase in gain margin by the addition of some precisely tuned electronic filters.

FIG. 3 is a graph plotting the frequency response of a dipole sensor (in the dot-dash curve) and a single microphone sensor (in the dashed line on top). The peak on the upper right of the graph is at a high frequency well above the range of human hearing and is caused by the dipole microphone spacing of 2.2 mm in this example. A larger microphone spacing in the dipole will cause this peak to be at a lower frequency. In the preferred embodiment the dipole peak is above the frequency response of the microphone as well as the upper limit of human hearing. The vertical double-headed arrow on the left side of the graph in FIG. 3 shows the difference in response on a decibel scale between the sound source of a vibrating string 5.1 mm from the dipole center and the sound amplified by 51 dB and reproduced by a loudspeaker rA=2 m away from the dipole as seen in FIG. 2. If this loudspeaker were placed at position B in FIG. 2 at any distance, the dipole response would be less than 0 dB due to the dipole null plane as described in FIG. 8. The double-headed arrow in FIG. 3 shows a difference, or "gain margin" of around 40 dB in the frequency range of 100 to 200 Hz, near most body resonances of a dreadnaught type of guitar meaning that the amplifier gain could be increased even further than 51 dB without cause feedback at the guitar resonances, which is very useful for amplified performances by musicians. So long as the gain margin is greater than a few dB, no unwanted feedback will occur. A gain margin of 0 dB is the same as having a feedback loop gain "EALP=1" in FIG. 1 which will lead to feedback oscillations. A negative gain margin corresponds to ELAP>1 which causes growing-amplitude feedback oscillations that quickly saturate the amplifier and annoy listeners. Acoustic feedback suppression along with the flat frequency response to nearby string vibrations for high fidelity signals are the objects of this invention. FIG. 4 shows a practical situation where the amplifier and loudspeaker do not have a flat constant frequency response, but rather have a high frequency roll off of −6 dB/octave around 5 kHz typical of many woofer or mid-range loudspeakers used in guitar amplifiers. In addition, a low pass filter with −6 dB/octave roll off starting at 10 kHz is inserted in the signal path to counteract the dipole peak seen on the upper right of the graph in FIG. 3. The frequency responses for the dipole in FIG. 4 show a nearly perfectly flat (high fidelity) response for the nearby guitar string 5.1 mm away and gain margin of at least 12 dB across the range of human hearing with an amplifier gain of 51 dB. For the situation in FIG. 4 the musician could turn up the amplifier another 10 dB and still not have feedback, yet have a very high fidelity signal from the dipole microphone due to its close proximity to the string sound source. The dipole response seen in FIG. 4 shows a maximum fidelity frequency response to the string while also suppressing amplified acoustic feedback by using additional low pass filtering.

The location and orientation of the dipole microphones is critical to the frequency response and acoustic feedback suppression because of the close proximity to the strings and the close separation of the two microphones in the dipole. The position precision must be held constant for the chosen low pass filtering to properly flatten out the frequency response. While the so-called gradient microphones available for speech communications may offer the same far field noise source (i.e. feedback) suppression, the response precision may not be adequate to achieve both the flat frequency response and simultaneous feedback suppression described here. This is because the permanent mounting of the pickup on the guitar relative to the strings can be held constant to a much greater precision than a gradient microphone located near a human mouth.

Figure 5A:
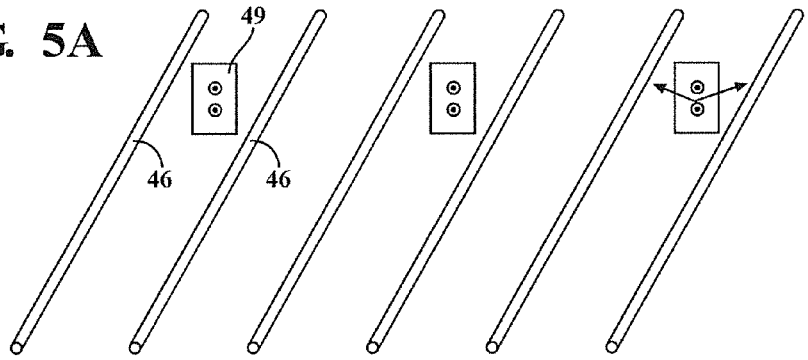
FIG. 5A is a top view of guitar strings and dipole microphones positioned in accordance with an embodiment of the present invention.
Figure 5B:
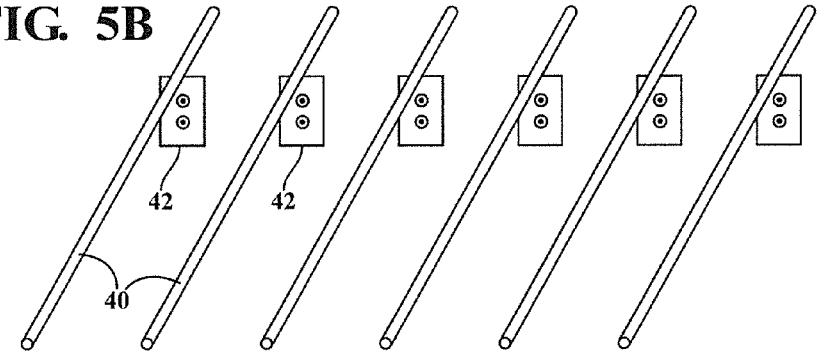
FIG. 5B is a top view of guitar strings and dipole microphones positioned in accordance with another embodiment of the present invention.

Given that the present invention provides control over the dipole microphone locations on the guitar, it then must be determined how many dipole microphones are needed and where should they be located relative to the strings. FIG. 5B depicts an embodiment of the present invention where each string 40 has a dipole microphone 42 mounted directly below it. The microphone outputs can be summed or recorded and processed separately for this arrangement, which could be useful for special effects processing or triggering polyphonic synthesizers for electronic music. In the embodiment of FIG. 5B, having a six dipole array arrangement, each dipole microphone will provide a well-isolated signal from only the adjacent string. In FIG. 5A a more economic arrangement is seen where a dipole microphone 44 is place equidistant to each string 46 in a pair of strings. This will result in a lower output, but in many cases this will be quite practical and effective at suppressing feedback and providing a high fidelity string vibration signal, provided the two microphones in each dipole pair have well matched sensitivities as can be implemented using trimming potentiometers.

Figure 6:
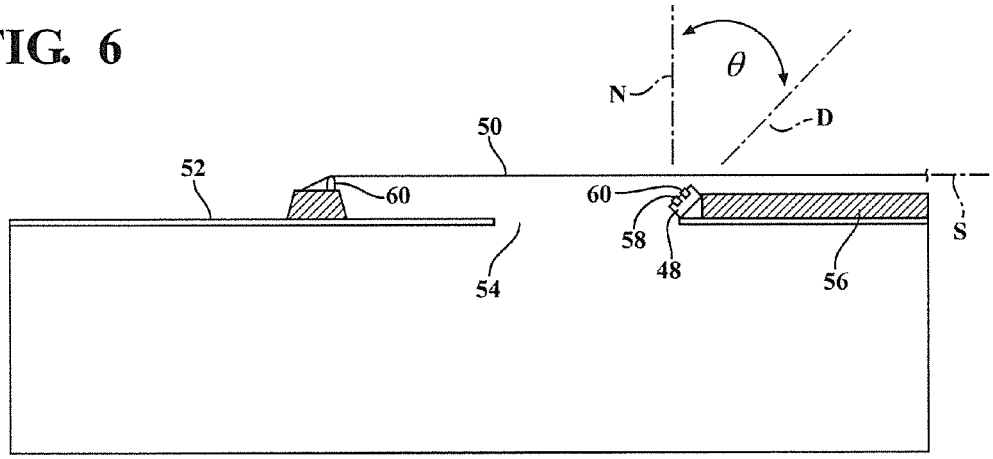
FIG. 6 is a cross-sectional side view of a portion of a guitar showing an orientation axis, θ, of a dipole microphone relative to a string, top plate, and sound hole for controlling the overall electronic fidelity.

There is also a sensitivity response to the vertical axis of the dipole microphone 48 relative to the string 50, top plate 52, and sound hole 54, as seen in FIG. 6. FIG. 6 shows the dipole microphone with an orientation axis D tilted toward the fingerboard 56 so as to form an angle θ with respect to an axis normal N to the string axis S. As shown, the microphone axis D is an axis extending through the two component microphones 58 and 60 forming part of the dipole microphone assembly 48. The portion indicated at 48 may be considered a base. As the orientation axis D tilts back away from the bridge 60, the null response of the dipole microphone 48 (as in the direction of loudspeaker B in FIG. 2 or in the null axis of FIG. 8) can be pointed in the direction of where the guitar player plucks the string or strikes the strings with the pick, thus attenuating the pick sound. Also, the sound radiating from the sound hole 54 can be exploited by tilting the axis D along the acoustic pressure gradient from the sound hole. This would have the effect of boosting the low frequency sounds from the guitar as a system, but would also affect the design of the frequency compensation filters. As will be clear to those of skill in the art, the orientation axis of the dipole microphone may be adjusted to various angles and this will affect the frequency response of the DMA in a profound way. If the orientation axis D is 90 degrees to the string axis S, the null plane will be normal to the string, which is not a particularly useful position since both sound from the sound hole and sound from the string would be cancelled. By tilting the axis, the position of the null plane can be tuned to reduce noise at particular areas, such as the pick area, and to greatly affect the balance between the bass response of the guitar and higher frequencies from the stings. In some embodiments, it is preferred that the orientation axis be in the range of +/−45 degrees from normal to the strings, though other ranges are possible. Also, in further embodiments, it may be preferred to place the DMA over the sound hole or to allow the player to blend the output signals from several DMA pickups simultaneously. The DMA array may also be skewed so that the dipole microphones near the treble strings are at a different distance from the bridge than the bass strings. The variation in positioning offers significant natural tone adjustment, more so than is available from typical "bass" and "treble" tone controls well known to those skilled in the art of audio engineering.

As shown in FIG. 6, the two component microphones, 58 and 60, in the dipole microphone assembly 48 are positioned such that their microphone diaphragms are pointed in the same orientation. As mentioned previously, the microphones, 58 and 60, are electrically wired out-of-phase, causing the described acoustic response of high fidelity for the string and acoustic feedback suppression to connected amplified loudspeakers, but also providing vibration cancellation, which is a very significant component of the feedback path into the guitar pickup. This "vibrationally coherent" orientation of the dipole microphone elements cancels most vibration that couple into both the microphone diaphragms identically due to the small separation and rigid common mechanical mounting of the microphones. This is because the mechanical wave speed between the two microphone elements is many times faster than the acoustical wave speed, thus the vibration components are nearly identical and therefore cancelled due to the out-of-phase wiring. At higher frequencies, above approximately 1 kHz, there is a greater chance of the microphones vibrating independently, allowing leakage through the signal differencing in the dipole circuit. These higher frequencies are more easily isolated from the DMA using foam rubber or other suitable materials as part of the mechanical mounting system.

Since the microphones in the dipole are so closely spaced, they also must be carefully matched in sensitivity to achieve the widest frequency response and best feedback suppression. This can be adjusted individually in the associated electronics, but fortunately, new microphone manufacturing technology is making this less of a concern. New micro electromechanical sensors (MEMS) techniques have created a reasonably consistent frequency response microphone made out of silicon which differ mostly in the net sensitivity (a simple voltage conversion scale factor). It is most desirable that the two microphones used in a particular dipole microphone be matched in sensitivity and frequency response. It is desirable that all dipole microphones in the array be identical, if possible. This can be achieved in DMA production using an automated test and calibration process where all the microphones are exposed to the same sound pressure level and a computer measures the net sensitivity of each microphone and adjusts a digital potentiometer to permanently match the responses of all the microphones in the DMA device. This provides the best possible performance and also provides for certified quality assurance and an opportunity to write a digital serial number and calibration data into the DMA device using a small digital memory chip, or even an RFID chip with data storage, to allow wireless remote reading of the DMA serial number and potentiometer positions. Digital potentiometers and electrically programmable read-only memory chips are available in surface mount chip sizes as small as 2 mm by 2 mm, allowing the DMA array, instrumentation amplifiers, digital potentiometers, and electronic filters to all fit on a single side of a printed circuit board small enough to fit under the strings at the end of a guitar fingerboard. However, since no two microphones will have identical potentiometer settings, the combination of the manufacturing serial number and the potentiometer settings provides for a unique authentication code for each manufactured DMA device, since these numbers would also be cataloged by the manufacturer. This preferred DMA calibration process not only allows for automated quality assurance, but also provides an effective means to detect counterfeit DMA products in the marketplace.

This embodiment is well-suited for automated production, quality assurance testing, and calibration. For example, the DMA devices can be produced in the same manner as all surface-mounted electronic circuit boards. The portion of the DMA indicated at 48 in FIG. 6 may represent a base, such as a portion of a printed circuit board or a housing around a circuit board, and the microphones 58 and 60 are supported on the circuit board, such as by soldering. The circuit boards can be loaded into an automated testing/calibration fixture where all microphones are exposed to the same sound pressure level, a computer measures the electrical signals from each microphone, digital potentiometers trim the microphone electrical signals to be of identical sensitivity, and the calibration result, DMA serial number, and other digital information is stored on the DMA circuit board in a read-only memory chip. The rigid printed circuit board design of the DMA is also the preferred embodiment for maximum vibration cancellation in the DMA at low frequencies for each microphone pair. While a typical 6-string guitar pickup would require 3 DMA microphone pairs (see FIG. 5A), the preferred embodiment is to manufacture the DMA as a pair of microphones and supporting electronics and memory chip on a small rigid printed circuit board. Multiple DMA microphone pairs would be connected together as needed to create the DMA array size required for the particular instrument using a common signal, DC power, and ground bus. This preferred embodiment allows the DMA microphone pairs to be placed as needed in different locations on the musical instrument, such as inside "F-holes", under the strings, inside the sound hole, over resonators, etc., to achieve the desired natural sound. The outputs of each DMA microphone pair can be simply summed, or mixed together, with appropriate gains to balance the tone of the overall DMA output. These specific design choices provide a path for economical manufacture, quality assurance, counterfeit detection, and high performance.

As will be clear to those of skill in the art, a sensitivity mismatch in dipole microphone pairs will lead to lower performance and variable sensitivity to each string. According to a further aspect of the present invention, this may be addressed by connecting a number of microphones together such that their aggregate outputs add together. The variability of each microphone is therefore significantly less important to the cancellation performance of feedback from a distant amplified loudspeaker. FIG. 7 shows such a microphone arrangement 70, which conveniently also provides for a balanced line output when the output impedance of the microphone array is below around 600 ohms. This arrangement still benefits from each microphone having a digital potentiometer to precisely match sensitivity during a quality assurance production step, but is enhanced further by the averaging effect of summing the microphone outputs. While this method of achieving the DMA is not as precise as using digital potentiometers to balance each microphone pair, it is much less costly for manufacturing.

If a high impedance output is desired, one skilled in the art can simply use an instrumentation amplifier or an audio transformer to convert the balanced output to a high impedance output. Balanced line outputs have the advantage of common mode interference cancellation. However, for the dipole array in FIG. 7, only differences in sound pressure between the top row of microphones and the bottom row of microphones will result in a signal between the (+) and (−) wires. This embodiment naturally cancels feedback from distant amplified sound as well as vibration and external electromagnetic interference. Using MEMS type of microphones with built in amplifiers, the summed array output impedance can easily drive the 600 ohm balanced line impedance and be powered via phantom power. This is a widely used technique for providing a 48 dc Volts power (10 ma of current) source over the balanced line wires without interfering with the audio signals on the wires. The array of MEMS can be powered using phantom power and a regulator where all components can be configured on a single compact printed circuit where only the signal cable needs to be attached, thus reducing manufacturing costs substantially. However, this arrangement works best if each microphone is trimmed with a potentiometer to have nearly identical sensitivity over the frequency range of interest.

The nearfield of a vibrating string, drum head, reed, or musical horn typically has sound fields where the pressure changes rapidly over small distances. Placing the DMA in these sound "nearfields" produces the desired object of this invention, which is a signal representing the acoustic sound heard with very high fidelity but also with very low sensitivity to nearby amplified sources of the same signal as a means to reduce acoustic feedback. For the guitar string example, assume a 2 mm by 3 mm MEMS microphone, arranged in dipole pairs where the midpoint of the dipole is 6 mm from the string (the microphones are 5 mm and 7 mm from the string respectively). The radial (r is distance) component of the sound field this close to a vibrating string can be seen as that from a vibrating cylinder.

$$P(r) = \frac{k^2\rho c Q}{4}\frac{\partial}{\partial r}\{H_0^{(2)}(kr)\} = \frac{k^2\rho c Q}{4}H_1^{(2)}(kr) \tag{1.3}$$

The function $H_1^{(2)}(kr)$ is a Hankel function of the second kind and has an important nearfield property this invention exploits to suppress acoustic feedback from amplified sources of the nearfield sound. The parameter Q is the source strength (m3/s), ρ is the density of air, c is the speed of sound, and k is the acoustic wavenumber $$\left(k = \frac{2\pi f}{c} = \frac{2\pi}{\lambda}\right).$$

As the product "kr" becomes small (the case for low frequencies and small distances from the string) the Hankel function behaves as $$\lim_{kr\to 0} H_1^{(2)}(kr) \approx \frac{1}{r}$$

meaning the sound field decays much more rapidly as distance is increased from the string. This approximation indicated that the sound field drops about 6 dB every doubling of distance. Subtracting the sound level for the 7 mm microphone (143) from the 5 mm microphone (200) leaves a residual of 57, which is attenuated by 10.9 dB from the 5 mm microphone level. Even though the dipole microphones are very close to the string, some small amount of cancellation still occurs. At farther distances from the string, the Hankel function behaves differently. As the product kr approaches unity and greater (approximately frequencies over 120 Hz and distances over 1 m)

$$\lim_{kr\to 1} H_1^{(2)}(kr) \approx \frac{1}{\sqrt{r}}$$

meaning that the sound field drops only 3 dB every doubling of distance. The attenuation increases significantly more in the directions defined by the null plane of the dipole as seen in FIG. 8. The sound nearfields of many musical instruments, in particular vibrating strings, drums, reeds, and horns exhibit this strong pressure gradient close to the radiating surface making the DMA an ideal transducer design for capturing the highest quality signal. Filters can be applied to remove any artifacts of the dipole response. However, when the DMA geometry is kept very small, these artifacts are beyond the frequency response of the microphones used. Furthermore, the DMA design specifically suppresses amplified acoustic feedback signals from nearby amplified sources of the DMA signal. For the case of an acoustic guitar, a bass-boosting shelving filter may be needed to increase the loudness of the DMA output below 500 Hz by about 15 dB to make the sound more like what one hears. This is because the strings excite the guitar body vibrations at low frequencies boosting the sound level relative to the string nearfields. Such filters are well known to those skilled in the art and can be applied to alter the sound color while maintaining feedback suppression if needed.

In some embodiments, the DMA sensitivity to the nearfield of the guitar string 72 may be further enhanced by adding a small baffle 74 between the two monopole microphones, 76 and 78, in each dipole microphone assembly 80, as shown in FIG. 9. This baffle, if small compared to wavelength has almost no effect on low frequency sound from a distant source such as the amplifying loudspeaker, but has a significant impact on the microphone responses to nearfield sound sources, especially at higher frequencies. This is because the nearfield sound is spreading as a spherical wave or even an exponentially decaying evanescent wave while a far field source produces a nearly plane wave that passes each microphone at nearly the same amplitude. This small baffle needs to be about as high as the two monopole microphone ports are separated to be effective (h≥2w in FIG. 9). However, if h>λ/4 (a quarter wavelength) the far field plane wave is not cancelled as well in the dipole along its axis, leading to feedback problems, particularly at high frequencies. The length of the baffle should be at least 4 times the height to suppress end-flanking paths of diffraction. This small baffle was found to enhance the signal from the strings by about 6 dB and slightly more for the sound radiating from the sound hole of the guitar with almost no effect on the sound from a distant loudspeaker. Maekawa (Z. Maekawa, "Noise Reduction by Screens," Journal of Applied Acoustics, 1, 157-173, (1968)), and others (S. I. Hayek, "Mathematical Modelling of Absorbant Highway Noise Barriers," Journal of Applied Acoustics, 31, 77-100, (1990)), have shown similar results for outdoor highway noise barriers based on the Fresnel number for the path difference over the barrier relative to the direct path. The typical noise barrier attenuation is well-known in the literature as given in equation (1.4) where N is the Fresnel number.

$$Att_{dB} \approx 20\log_{10}\frac{\sqrt{2\pi N}}{\tanh\sqrt{2\pi N}} \quad (1.4)$$

$$N = \frac{2\delta}{\lambda} \quad \delta = A + B - C - 2w$$

For low frequencies, the wavelength is large compared to the barrier over-the-top path minus the path if the barrier were absent (the path difference) making N very small and the barrier attenuation only slightly over 0 dB, meaning the barrier has virtually no effect on the sound. But for higher frequencies, which have shorter wavelengths, or for sources close to the barrier (the path "C" is small in FIG. 9 for a nearby guitar string), N becomes larger and the barrier attenuation greater. The microphone in the shadow of the barrier receives a weaker acoustic signal so the dipole cancellation is not complete, thus the output of the DMA is higher, enhancing the near-field response and the overall response for higher frequencies. For near-field sources, the different path lengths lead to significantly different spherical spreading losses, which is not the case for far-field sources. Therefore, the small barrier tends to shield a low frequency near-field source much better than a far-field source such that the DMA output signal will end up being louder for a near-field source (such as a nearby vibrating string) compared to a far-field source (such as an amplified loudspeaker) of the same sound level.

As such, the small baffle improves the main object of the invention by enhancing the sound from the guitar while maintaining suppression of acoustic feedback from an amplified loudspeaker. However, use of the baffle is not required to exploit the invention. The main effect of the baffle is seen to enhance the near field and high frequencies while having little effect on the far field sound at the expense of a little less feedback suppression at high frequencies.

The DMA can be implemented using microphone pairs (DMA2) on a printed circuit board or similar mechanical mount where several DMA2 devices can be distributed to key sound source areas of the musical instrument and the electrical outputs from two or more DMA2s are electrically summed or "mixed" at proportional voltage levels. This accommodates stringed instruments where the sound hole is not located directly under the strings, such as the "F-holes" on a classical violin, cello, or bass, piano, as well as some guitars and bases with f-holes or offset or multiple sound holes. This is of particular value for resonator guitars where one or more metal diaphragms are excited by string vibrations and the characteristic sound is a mix of resonator vibrations, string vibrations, sound hole vibrations, and body vibrations. For this application a number of DMA2 devices would be placed over the resonator(s), sound hole(s), and/or the strings and electrically mixed to accurately capture the complex acoustic sounds heard.

A wind screen surrounding the DMA and diffraction baffle is necessary for use outdoors and to prevent other sources of wind turbulence from detection. Wind screen designs are well known, and generally consist of a thin barrier of around 50% porosity, and in the case of the DMA, should be vibrationally isolated from the baffle and DMA supporting structure to prevent vibrations on the wind screen from exciting the microphones mechanically. For this reason, it may be desirable to place the DMA inside the sound hole (or F-hole) of a stringed instrument and to cover the inside of the sound hole or F-hole with a fabric to serve as a wind screen.

While the present invention has been described for use with an acoustic guitar, further embodiments may be used with other instruments. As a first set of examples, DMAs similar to those described herein may be used with other stringed instruments, with the DMAs mounted on the body of the instrument. As described above, this arrangement provides vibrational cancellation. The positioning of the DMAs is chosen and adjusted so as to provide the desired acoustical performance characteristics. In further examples, DMAs may be used on non-stringed instruments, such as brass and wind instruments. In some embodiments, an array of DMAs is used and in certain embodiments the DMAs are again mounted on the surface of the instrument itself, such as the bell of a brass instrument, or near the skins of a percussion instrument.

As will be clear to those of skill in the art, the herein described embodiments of the present invention may be altered in various ways without departing from the scope or teaching of the present invention. It is the following claims, including all equivalents, which define the scope of the invention.

I claim:

1. A dipole microphone array for an acoustical stringed instrument of the type having a body and a plurality of strings spaced from the body, the array comprising:

a plurality of microphone assemblies each having a first and a second microphone, the second microphone being out of phase with the first microphone so as to provide a dipole microphone assembly;

each of the microphone assemblies being mounted on the body of the instrument in close proximity to at least one of the strings; and each microphone assembly being mounted generally equidistant to two of the strings.

2. A dipole microphone array in accordance with claim 1, further comprising:

a printed circuit board; and the first and second microphones of each microphone assembly being supported on the printed circuit board.

3. A dipole microphone array in accordance with claim 2, wherein:

the first and second microphones are soldered to the printed circuit board.

4. A dipole microphone array in accordance with claim 1, further comprising:

a baffle disposed between the first and second microphones of at least some of the microphone assemblies.

5. A dipole microphone in accordance with claim 4, wherein:

the first and second microphone are separated by a first distance; and the baffle has a height equal to or greater than the first distance.

6. A dipole microphone array in accordance with claim 1, further comprising:

a vibrationally isolated windscreen disposed around the remainder of the dipole microphone array.

7. A dipole microphone array in accordance with claim 1, wherein:

the first and second microphones define an orientation axis for each dipole microphone assembly; and the orientation axis is angled with respect to an axis normal to the strings.

8. A dipole microphone array in accordance with claim 7, wherein:

the orientation axis is angled with respect to the axis normal to the strings in the range of +45 degrees to −45 degrees.

9. A dipole microphone array for an acoustical instrument of the type having a body, the array comprising:

a plurality of microphone assemblies each having a first and a second microphone separated by a first distance, the second microphone being out of phase with the first microphone so as to provide a dipole microphone;

each of the microphone assemblies being mounted on the body of the instrument; and a baffle disposed between the first and the second microphones of at least some of the microphone assemblies, the baffle having a height equal to or greater than the first distance.

10. A dipole microphone array in accordance with claim 9, further comprising:

a printed circuit board; and the first and second microphones of each microphone assembly being supported on the printed circuit board.

11. A dipole microphone array in accordance with claim 10, wherein:

the first and second microphones are soldered to the printed circuit board.

12. A dipole microphone array for an acoustical stringed instrument of the type having a body and a plurality of strings spaced from the body,the array comprising:

a plurality of microphone assenblies each having a first and second microphone separated by a first distance the second microphone being out of phase with the first microphone so as to provide a dipole microphone assembly;

each of the microphone assemblies being mounted on the body of the instrument in close proximity to one of the strings; and a baffle disposed between the first and second microphones of at least some of the microphone assemblies, the baffle has a height equal to or greater than the first distance.

13. A dipole microphone array in accordance with claim 12, further comprising:

a printed circuit board; and the first and second microphones of each microphone assembly being supported on the printed circuit board.

14. A dipole microphone array in accordance with claim 13, wherein:

the first and second microphones are soldered to the printed circuit board.

15. A dipole microphone array in accordance with claim 12, further comprising:

a vibrationally isolated windscreen disposed around the remainder of the dipole microphone array.

16. A dipole microphone array in accordance with claim 12, wherein:

the first and second microphones define an orientation axis for each dipole microphone assembly; and the orientation axis is angled with respect to an axis normal to the strings.

17. A dipole microphone array in accordance with claim 16, wherein:

the orientation axis is angled with respect to the axis normal to the strings in the range of +45 degrees to −45 degrees.

18. A dipole microphone array for an acoustical stringed instrument of the type having a body and a plurality of strings spaced from the body, the array comprising:

a plurality of microphone assemblies each having a first and second microphone, the second microphone being out of phase with the first microphone so as to provide a dipole microphone assembly;

each of the microphone assemblies being mounted on the body of the instrument in close proximity to one of the strings; and the first and second microphones define an orientation axis for each dipole microphone assembly, the orientation axis being angled with respect to an axis normal to the strings.

19. A dipole microphone array in accordance with claim 18, further comprising:

a printed circuit board; and the first and second microphones of each microphone assembly being supported on the printed circuit board.

20. A dipole microphone array in accordance with claim 19, wherein;

the first and second microphones are soldered to the printed circuit board.

21. A dipole microphone array in accordance with claim 18, further comprising:

a baffled disposed between the first and second microphones of at least some of the microphone assemblies.

22. A dipole microphone array in accordance with claim 18, further comprising:

a vibrationally isolated windscreen disposed around the remainder of the dipole microphone array.

23. A dipole microphone array in accordance with claim 18, wherein:

the orientation axis is angled with respect to the axis normal to the strings in the range of +45 degrees to −45 degrees.

* * * * *